US005729802A

United States Patent [19]

Hirabayashi et al.

[11] Patent Number: 5,729,802

[45] Date of Patent: Mar. 17, 1998

[54] CONTACT CHARGER FOR CHARGING A PHOTOSENSITIVE MEMBER

[75] Inventors: Jun Hirabayashi, Kawaski; Nobuyuki Ito, Oume; Harumi Ishiyama, Yokohama; Tadashi Furuya, Kawasaki; Yasunori Chigono, Yokohama; Seiji Mashimo, Tokyo, all of Japan

[73] Assignee: Canon Kabushiki Kaisha, Tokyo, Japan

[21] Appl. No.: 709,739

[22] Filed: Sep. 9, 1996

[30] Foreign Application Priority Data

Sep. 8, 1995 [JP] Japan ..... 7-231830
Aug. 29, 1996 [JP] Japan ..... 8-228523

[51] Int. Cl.[6] ..... G03G 15/02

[52] U.S. Cl. ..... 399/174; 361/225

[58] Field of Search ..... 399/168, 174, 399/175, 176, 50; 361/212, 221, 225

[56] References Cited

U.S. PATENT DOCUMENTS 5,485,248 1/1996 Yano et al. ..... 399/73
5,499,080 3/1996 Furuya et al. ..... 399/50
5,655,188 8/1997 Nagamori et al. ..... 399/174

FOREIGN PATENT DOCUMENTS 0576203 12/1993 European Pat. Off. .
0596477 5/1994 European Pat. Off. .
0622703 11/1994 European Pat. Off. .
0709746 5/1996 European Pat. Off. .
63-149669 6/1988 Japan .
6-3921 1/1994 Japan .

*Primary Examiner*—S. Lee
*Attorney, Agent, or Firm*—Fitzpatrick, Cella, Harper & Scinto

[57] ABSTRACT

An image forming apparatus includes an image bearing device, a charger contactable to the image bearing device for effecting contact charging of the image bearing device, the charger being supplied with a voltage having a DC component and an AC component, and the charger being provided with an electrode for receiving the voltage; wherein the following is satisfied: when an electric field formed between the image bearing device and the electrode is not more than $|E/d_{SD}|$ (V/m), a resistance of the charger per unit area of contact between the image bearing device and the charger is larger than $$20E/(wCV_{DC})\ (\Omega m^2)$$

and is larger than the resistance when the electric field is more than $|(E+V_{DC})/d_{SD}|$ (V/m)

where E(V) is an amplitude of the AC component; w(rad) is an angular velocity of the AC component; $d_{SD}$ (m) is a minimum distance between the electrode and the image bearing device; $C(F/m^2)$ is an electrostatic capacity per unit area of the image bearing device; and $V_{DC}$ (V) is a voltage of the DC component.

8 Claims, 8 Drawing Sheets

| MAG. BRUSH | DC | DC+AC |
|---|---|---|
| A | G | G |
| B | G | G |
| C | G | NG |
| D | G | G |
| E | G | NG |

G: GOOD
NG: NO GOOD

FIG. 7

| MAG. BRUSH | 200Hz | 600Hz | 1000Hz | 1400Hz |
|---|---|---|---|---|
| A | G | G | G | G |
| B | G | G | G | G |
| C | NG | NG | NG | NG |
| D | G | G | G | G |
| E | NG | NG | NG | NG |

FIG. 8

| MAG. BRUSH | CHARGING | FOG | PIN HOLE LEAG |
|---|---|---|---|
| A | NG | G | G |
| B | G | G | G |
| C | G | NG | G |
| D | NG | NG | G |
| E | G | NG | NG |

FIG. 9

CONTACT CHARGER FOR CHARGING A PHOTOSENSITIVE MEMBER

FIELD OF THE INVENTION AND RELATED ART

The present invention relates to an image forming apparatus comprising a charging member which is placed in contact with the image bearing member of the image forming apparatus in order to charge (or discharge) the image bearing member.

First, the surface of the image bearing member such as an electrophotographic photosensitive member or an electrostatic (dielectric) recording member is uniformly charged with the use of a charging member. Then, an optical image correspondent to an original image is protected onto the uniformly charged surface of the image bearing member so that the electrical potential is removed from the area irradiated with the optical image. As a result, an electrostatic latent image correspondent to the original image is formed. Next, in a developing section, toner is adhered to the electrostatic latent image to develop (visualize) the latent image into a toner image. The toner image is transferred onto a transfer material, in a transfer section, and is fixed to the transfer material, in a fixing section. Meanwhile, the toner remaining on the surface of the image bearing member after the toner image is transferred onto the transfer material in the transfer section is removed by a cleaning member, and then, the cleaned image bearing member is used for the following image formation.

In the past, a corona type charging device has been used as means for charging the aforementioned image bearing member. However, in recent years, a so-called contact type charging apparatus has been put to practical use. In the case of the contact type charging apparatus, a charging member, to which voltage is applied, is placed in contact with the image bearing member to charge the image bearing member. The usage of the contact type charging apparatus is intended for reducing ozone generation and power consumption. In terms of charge stability, a charging apparatus based on the roller charge system employing an electrically conductive roller as the charging member is preferable. In order to charge the image bearing member using the charging apparatus based on the roller type charge system, an electrically conductive elastic roller (hereinafter, "charge roller") as the charging member is placed in contact with the image bearing member, with application of a predetermined contact pressure, and a predetermined voltage is applied to the charge roller. More specifically, the image bearing member is charged through the electrical discharge from the charging member to the image bearing member. Therefore, the charging of the image bearing member starts as the value of the voltage applied to the charging member exceeds a threshold voltage value. For example, in order to charge an image bearing member having a 25 μm thick OPC layer by placing a charging roller in contact with the image bearing member, a voltage of approximately 640 V or more must be applied to the charge roller. Above the 640 V, the surface potential of the photosensitive member linearly increases in proportion to the value of the applied voltage. Let it be that the aforementioned threshold voltage value, that is, the charge start voltage, is $V_{th}$. In order to charge the photosensitive member surface to a potential of $V_d$ which is necessary for electrophotography, a DC voltage exceeding the necessary surface potential $V_d$ ($V_d$+$V_{th}$) must be applied to the charge roller. This system of applying only DC voltage to the contact type charging member in order to charge the image bearing member is called "DC charge system."

In the case of the DC charge system, the resistance of the contact type charging member changes because of environmental changes and the like. Also, the thickness of the photosensitive layer is changes due to shaving, which changes the value of $V_{th}$. Therefore, it is difficult to charge the photosensitive member to a desired potential level. Thus, in order to charge more uniformly the image bearing member, a charging system such as those disclosed in Japanese Laid Open Patent Application No. 149,669/1988 and the like publications is employed. Those systems are called "AC charge system," in which an oscillating voltage composed by superposing an AC voltage component having a peak-to-peak voltage of more than twice the charge start voltage $V_{th}$ on a DC voltage equivalent to the desired $V_d$ is applied to the contact type charging member. This "AC charging system" is intended to make use of the potential averaging effect of AC voltage, wherein the potential of the image bearing member converges to the $V_d$ which is the center of the peaks of the AC voltage, and is not affected by the external disturbance such as the environmental changes.

However, even in the case of the contact type charging apparatus such as those described above, the charging mechanism is fundamentally based on a phenomenon of the electrical discharge from the charging member to the image bearing member. Therefore, the voltage applied to the charging member to charge the image bearing member must have a value more than the desired surface potential level of the image bearing member. As a result, even the contact type charging system generates ozone although the amount is small.

Thus, a new charging system which directly injects electrical charge into the image bearing member has been proposed in Japanese Laid Open Patent Application No. 003,921/1994 and the like publications. According to this new charging system, voltage is applied to a contact type charging member such as a charge roller, a charge brush, a magnetic charge brush, or the like to directly inject electrical charge into a charge holding member such as a trap level or electrically conductive particles which are on the surface of the image bearing member. In the case of this charging system, the role of the electrical discharge phenomenon is not dominant, and therefore, the voltage necessary for charging the image bearing member has only to be equal to the potential to which the surface of the image bearing member is desired to be charged. Consequently, no ozone is generated.

However, when the bias applied for charging the image bearing member contains an AC component, the aforementioned systems suffers from the following problems. That is, since the potential of the image bearing member follows the voltage applied to the charging member, the surface potential of the image bearing member varies in response to the AC component. As a result, the surface potential of the image bearing member becomes nonuniform.

FIG. 10 schematically illustrates the above problem. In FIG. 10, the horizontal axis represents the time it takes for a given point on the drum to approach, pass, and move away from, a charging nip, and the vertical axis represents the applied voltage, or the charge potential. In the case of a roller type charging system based on the electrical discharge, the gap between the given point on the image bearing member and the charge roller changes as the point on the image bearing member passes the charge nip, and therefore, the discharge start voltage $V_{th}$ changes in a manner of large small large. Consequently, the final potential of the image bearing member takes a value of $V_{DC}$ (applied DC voltage). But, when the contact type charge injection system is employed, the final surface potential of the image bearing member is the very surface potential of the image bearing member of the moment when the contact between the image bearing member and the charging member ends. Further, since the phase of the bias applied to each of the various points on the surface of the image bearing member is random, the surface of the image forming member is non-uniformly charged in a random pattern, which is a problem.

On the other hand, it has been desired to reduce the time it takes for the surface potential of the image bearing member to rise to the desired potential level.

SUMMARY OF THE INVENTION

Accordingly, a primary object of the present invention is to provide an image forming apparatus capable of preventing the image bearing member from being nonuniformly charged by the AC component of the voltage applied to the charging member.

Another object of the present invention is to provide an image forming apparatus capable of uniformly charging the image bearing member so that a preferable image can be formed.

Another object of the present invention is to provide an image forming apparatus capable of directly injecting electric charge into the image bearing member from the charging member through the contact between the charging member and the image bearing member.

Another object of the present invention is to provide an image forming apparatus capable of reducing the time it takes for the surface potential of the image bearing member to rise to a desired potential level.

These and other objects, features and advantages of the present invention will become more apparent upon a consideration of the following description of the preferred embodiments of the present invention, taken in conjunction with the accompanying drawings.

BRIEF DESCRIPTION OF THE DRAWINGS

FIG. 7 is a table showing the results of the evaluation made of the fogs in the images formed when the frequency of the AC bias was fixed at 500 Hz.

FIG. 8 is a table showing the results of the evaluation made of the fogs in the images formed when the amplitude of the AC bias was fixed at 1,000 V, and the frequency of the AC voltage was varied.

FIG. 9 is a table showing the results of the evaluation made of the images formed when the process speed was increased, and a charge bias composed of a DC voltage of 700 V and an AC voltage having a frequency of 700 Hz and an amplitude of 600 V was used.

DESCRIPTION OF THE PREFERRED EMBODIMENTS

Hereinafter, the preferred embodiments of the present invention will be described with reference to the drawings.

Figure 2A:
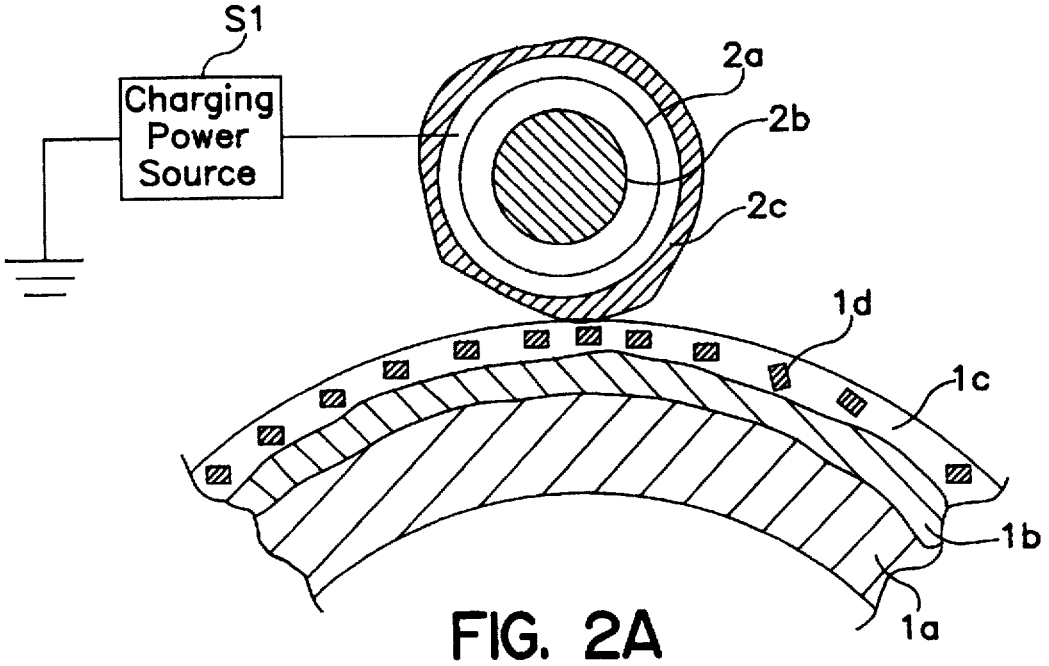
FIG. 2(*a*) is an enlarged schematic section of the contact type charging member in the first embodiment of the present invention, and FIG. 2(*b*) is a schematic drawing of a model equivalent to the charging member illustrated in FIG. 2(*a*).
Figure 2B:
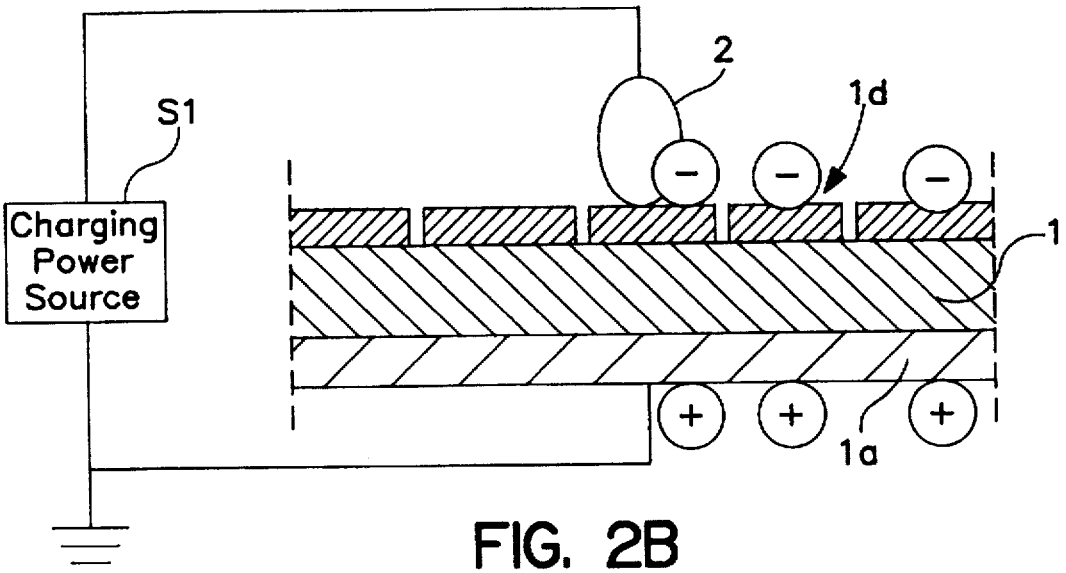

FIG. 2(*a*) illustrates a magnetic brush type charging device as the contact type charging apparatus for charging the photosensitive member as the image bearing member of an image forming apparatus, and FIG. 2(*b*) illustrates a model equivalent to the charging device illustrated in FIG. 2(*a*).

The magnetic brush employed in this embodiment comprises an electrically conductive, nonmagnetic, rotary sleeve 2a having a diameter of 16 mm, a 230 mm long magnetic roller 2b, and electrically conductive magnetic particles 2c adhered to the surface of the sleeve 2a by the magnetic force of the magnetic roller 2b. The magnetic roller 2b is rendered rotatable within the conductive sleeve 2a so that the orientation of the magnetic pole can be optionally set. The distance between the conductive sleeve 2a and the surface of the photosensitive member 1 is set to 500 μm, and a layer of the magnetic particles 2c is formed as a contact between the conductive sleeve 2a and the photosensitive member 1.

To the conductive sleeve 2a, a voltage comprising an AC component and a DC component is applied by a power source $S_1$ to charge the surface of the photosensitive member 1. The photosensitive member 1 is shaped like a drum, and comprises an electrically conductive, grounded base member 1a, a photosensitive layer 1b supported by the base member 1a, and a charge carrier layer 1c disposed on the surface of the photosensitive member 1. The charge carrier layer 1c is composed of binder, for example, acrylic resin, and a large number of electrically conductive particles ($SnO_2$ particles) dispersed in the binder. Electric charge is injected into the charge carrier layer 1c through the contact between the magnetic particle layer 2c and the charge carrier layer 1c. The volumetric resistivity of the charge carrier layer 1c is preferably in a range of $1\times10^9$ Ω·cm–$1\times10^{14}$ Ω·m, which is determined by measuring the volumetric resistivity of a sample sheet of the charge carrier layer using HIGH RESISTANCE METER 4329A (Yokogawa-Hewlett Packard) connecint a resistivity cell thereto.

Figure 11:
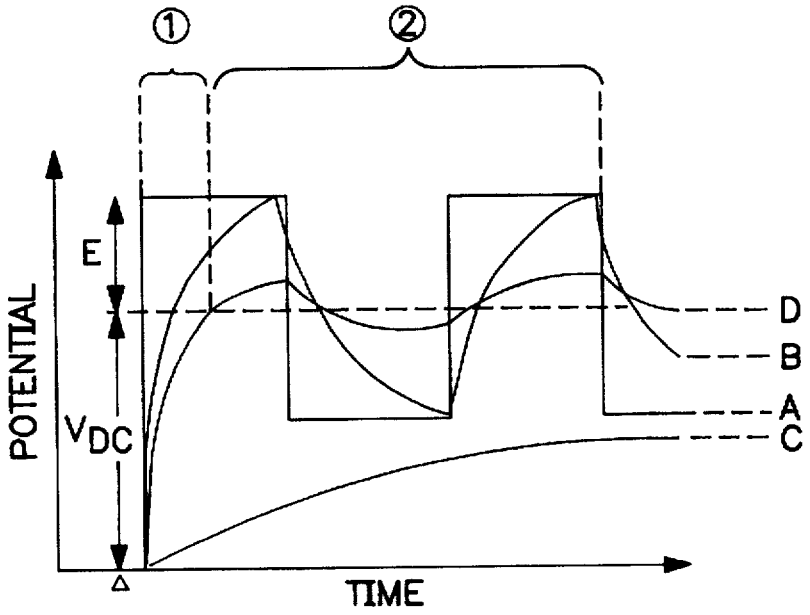
FIG. 11 is a graph showing the relationship between the elapsed time and the applied voltage (electrical potential).

FIG. 11 is a graph showing the changes in the electrical potential level of the object such as the photosensitive member being charged, in relation to the elapsed time. Line A represents the voltage (comprising a DC component and an AC component) applied to the contact type charging device. $V_{DC}$ stands for the DC component of the applied voltage, and E is the amplitude (½ of peak-to-peak voltage) of the AC component of the applied voltage. Lines B, C and D, which represent the potential levels of the object being charged, correspond to different resistances of the contact type charging device.

When the resistance value of the contact type charging member is sufficiently small, the electrical potential of the object being charged follows the applied voltage as depicted by Line B, and therefore, the surface potential of the charged object becomes substantially nonuniform.

On the contrary, when the resistance value of the contact type charging member is sufficiently large, the potential of the object being charged does not follow the applied voltage, which is depicted by Line C, and therefore, the surface potential of the charged object does not become nonuniform. However, in this case, it takes a much longer time to raise the surface potential of the object being charged to a target level. In other words, this method is inferior in terms of charging speed.

This problem of inferior charging speed can be eliminated by employing a contact type charging member whose resistance value remains low in Period (1), and high in Period (2), in FIG. 11. When such a contact type charging member is employed, the surface potential of the object being charged displays the characteristic depicted by Line D; the occurrence of the nonuniformity in the surface potential can be prevented while maintaining a preferable charging speed.

The resistance characteristic of the charging member described above can be realized by employing a charging member whose resistance value is dependent on the strength of the electric field, that is, whose resistance is low in a strong electric field, but is high in a weak electric field. In FIG. 11, the differences between the potentials depicted by Lines B, C and D, and the applied voltage A represent the differences in potential (electric fields) affecting the contact type charging member. Line D represents a case in which the resistance value is low in Period (1) in which a strong electric field is formed to affect the contact type charging member, and is high in Period (2) in which a weak electric field is formed to affect the contact type charging member; therefore, the occurrence of the nonuniformity in the surface potential of the object being charged can be prevented while maintaining a preferable charging speed.

When the length of the path from the electrode (electrically conductive sleeve 2*a* in FIG. 2) for applying voltage to the contact type charging device, to the surface of the photosensitive member through a part (surface portion) of the contact type charging device is $d_{SD}$ (m); the amplitude of the AC component of the applied voltage is E (V); and the DC component of the applied voltage is $V_{DC}$ (V), then the electric field to which the contact type charging member is subjected in Period (1) is no less than $|E/d_{SD}|$ (V/m), and is no more than $|(E+V_{DC})/d_{SD}|$ (V/m), and the electric field to which the contact type charging member is subjected in Period (2) is no more than $|E/d_{SD}|$ (V/m).

Therefore, the occurrence of the nonuniformity in the surface potential of the charged object can be prevented while maintaining a preferable charging speed, by changing, that is, by reducing, the resistance value of the contact type charging member in Periods (1), and increasing the resistance value of the contact type charging member in Period (2).

According to the results of the experiments conducted by the inventors of the present invention, when the strength of the electric field is no more than $|E/d_{SD}|$ (V/m), the occurrence of the nonuniformity in the surface potential of the object being charged, which is caused by the AC component of the applied voltage, can be prevented by increasing the unit area resistance of the contact formed between the object to be charged and the contact type charging member to a level higher than $20/wC \cdot V_{DC}$ ($\Omega m^2$), wherein C ($F/m^2$) stands for the electrostatic capacity per unit area of the object to be charged, and w (rad) stands for the angular velocity of the AC component of the applied voltage.

When the strength of the electric field is no more than $|E/d_{SD}|$ (V/m), the time it takes for the potential of the object to be charged to rise to a target level can be shortened by increasing the unit area resistance of the contact portion formed between the object to be charged and the contact type charging member, to a level which is higher than the resistance level of the contact type charging member, in the period in which the strength of the electric field is no less than $|E/d_{SD}|$ (V/m) and no more than $|(E+V_{DC})/d_{SD}|$ (V/m).

Also, according to the results of the experiments conducted by the inventors of the present invention, when the strength of the electric field is no less than $|E/d_{SD}|$ (V/m) and no more than $|(E+V_{DC})/d_{SD}|$ (V/m), the pinhole leak from the charging member to the photosensitive member can be prevented by increasing the unit area resistance of the aforementioned contact portion to a level above 1 ($\Omega m^2$).

Figure 3:
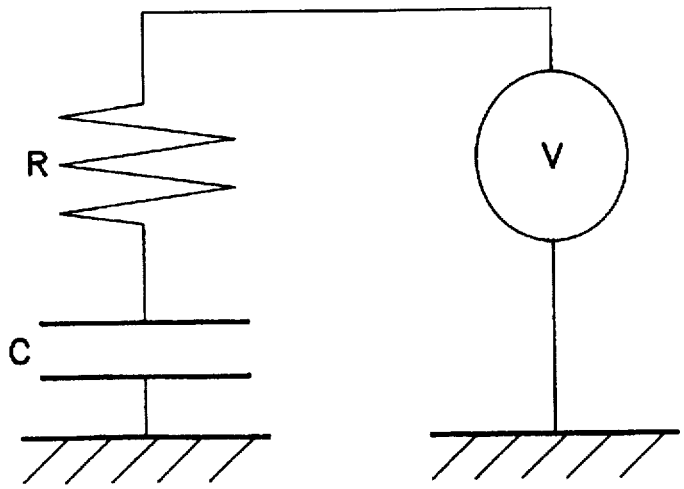
FIG. 3 is a diagram depicting the contact type charge injection.

The charging apparatus illustrated in FIG. 2(*a*) may be approximated by the equivalent circuit given in FIG. 3. In other words, it may be theorized that in the case of the charging apparatus in FIG. 2(*a*), electric charge is injected into the object having an electrostatic capacity of C ($F/m^2$) per unit area with the use of a contact type charging member having a unit area resistance of R ($\Omega m^2$) at the contact portion formed between itself and the object to be charged. The unit area resistance R(x) ($\Omega m^2$) of the contact type charging member can be determined by measuring the time constant of the photosensitive drum potential when voltage is applied to the photosensitive drum using the contact type charging member.

There is a following relation:

$$R(E(t)-q(t)/C)q(t)/t+q(t)/C=E(t) \quad (1)$$

R(x) ($\Omega m^2$) stands for a unit area resistance value of the contact type charging member when the strength of the electric field is at a level of x; E(t) stands for the applied voltage; and q(t) stands for the amount of charge which the photosensitive member receives during an elapsed time of t.

Assuming that the AC component in the applied voltage is in the form of sine wave, $$E(t)=V_{DC}+E \sin(wt) \quad (2)$$

$V_{DC}$ (V) stands for the DC component of the applied voltage. When a sufficient length of time t (S) is allowed for charge injection, the obtained drum potential VD (V) can be expressed by the following formula:

$$VD=V_{DC}+(-E)\{\cos(wt+\theta)\}/[w^2C^2\{R_1^2+(1/wC)^2]^{1/2} \quad (3)$$

$R_1$ ($\Omega m^2$) stands for the unit area resistance value of the contact portion of the charging member when an electric field having a strength of no more than $|E/d_{SD}|$ (V/m) is formed between the electrode of the charging member and the surface of the photosensitive member, and $d_{SD}$ (m) stands for the length of the shortest path from the electrode of the charging member to the surface of the photosensitive member. θ (rad) stands for the phase angle of the AC component of the applied voltage when t=0 (at the moment when charging begins).

As charge is injected into the photosensitive member from the charging member through the contact between the two members, the drum potential changes in response to the AC component of the applied voltage, which is expressed by the second term of the right-hand side of Formula (3). In order to obtain a preferable image, it is preferable to suppress the amplitude of the above change of the potential to a level below 5% of $V_{DC}$. In other words, $$-E\{\cos(wt+\theta)\}/[w^2C^2\{R_1^2+(1/wC)^2\}]^{1/2}<0.05V_{DC}$$

Modifying the above formula, $$1/wC\{(20E/V_{DC})^2-1\}^{1/2}<R_1 \quad (4)$$

The amplitude E is preferably larger to a certain degree in order to enhance the effects of the AC component; in other words, $$E>>V_{DC}/20$$

Since $(20E/V_{DC})^2>>1$ $$(20E/V_{DC})^2-1=(20E/V_{DC})^2 \quad (5)$$

Combining Formulas (4) and (5), $$20E/(wCV_{DC})<R_1$$

In other words, when an electric field having a strength of no more than $|E/d_{SD}|$ (V/m) is formed between the electrode of the charging member and the surface of the photosensitive member, the unit area resistance value $R_1$ ($\Omega m^2$) of the contact portion of the charging member is preferred to be larger than $20E/(CV_{DC})$, so that the electric potential change caused by the AC component of the applied voltage can be reduced.

From the definition, $$F(E,w,C,V_{DC})=20E/wCV_{DC}$$

Combining the last two formulas results in:

$$F(E,w,C,V_{DC})<R_1$$

In consideration of Fourier series for synthesization with doubled sine waves, the relation expressed by the above formula holds even when the component of the applied bias is in the form a wave other than sine wave.

In order to form an image at a high speed, the time necessary to charge the photosensitive member is preferred to be reduced. Therefore, in addition to the above conditions, it is preferable that in Period (1) in FIG. 11 (period in which the potential of the object being charged rises to $V_{DC}$), the unit area resistance value of the aforementioned contact portion is smaller than that in Period (2) (period after the potential of the object being charged rises to $V_{DC}$).

Further, when the electric field formed between the electrode of the charging member and the object to be charged is no less than $|E/d_{SD}|$ (V/m) and no more than $|(E+V_{DC})/d_{SD}|$ (V/m), and also, the unit area resistance value $R_2$ ($\Omega m^2$) of the aforementioned contact area is no more than 1 ($\Omega m^2$), excessive current flows into the defective areas such as a scratched area having low resistance from the contact type charging member, causing various problems such as charge failure in the surrounding areas, enlargement of pinhole, or destruction of the contact type charging member itself. Therefore, it is preferable that the resistance value $R_2$ ($\Omega m^2$) of the contact type charging member is no less than 1 ($\Omega m^2$).

It is preferable that the resistance value of the charge carrier layer, or the resistance value of a layer which covers the charge carrier layer, provided that the photosensitive drum comprises such a layer, displays electric field dependency, and becomes lower when the strength of the electric field is no less than $|E/d_{SD}|$ (V/m) and no more than $|(E+V_{DC})/d_{SD}|$ (V/m), than when the strength of the electric field is no more than $|E/d_{SD}|$ (V/m).

Next, an embodiment of the image forming apparatus capable of satisfying the above described requirements will be described with reference to FIG. 1.

Embodiment 1

Figure 1:
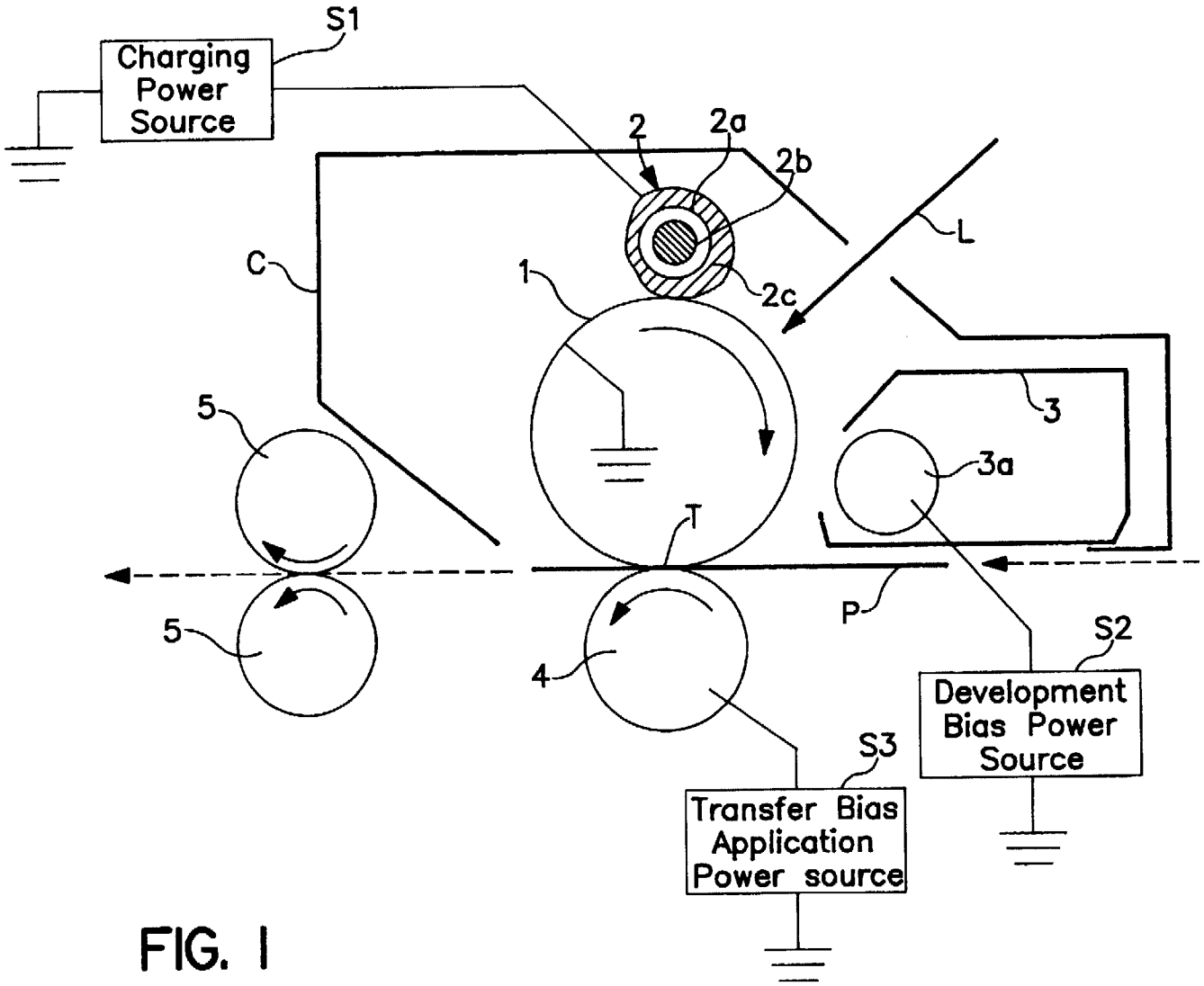
FIG. 1 schematically illustrates the general structure of the image forming apparatus in the first embodiment of the present invention.

FIG. 1 is a schematic drawing depicting the general structure of an image forming apparatus in accordance with the present invention. The image forming apparatus in this embodiment is a laser beam printer employing an electrophotographic process. A reference numeral 1 designates an electrophotographic photosensitive member as the image bearing member in the form of a rotary drum. In this embodiment, it is an OPC based photosensitive member having a diameter of 16 mm, and is rotated in the direction of the arrow mark at a peripheral velocity of 94 mm/sec. A reference numeral 2 designates a magnetic brush as the contact type charging member which is disposed in contact with the photosensitive member 1. The magnetic brush 2 comprises an electrically conductive nonmagnetic, rotary sleeve 2*a*, a magnet roller 2*b* enclosed within the rotary sleeve 2*a*, and electrically conductive magnetic particles 2*c* (in this embodiment, ferrite particles) adhered on the surface of the sleeve 2*a*. The magnet roller 2*b* is fixedly disposed. The sleeve 2*a* is rotated in such a manner that the peripheral velocity equals 100% of the velocity of the photosensitive member 1, and the rotating direction of the sleeve 2*a* at the contact between the two members becomes opposite to that of the photosensitive member 1. Charge bias is applied so that the peripheral surface of the photosensitive member 1 is uniformly charged to substantially −700 V. Even though a magnetic brush is employed as the contact type charging member in this embodiment, the charging member compatible with the present invention is not limited to the magnetic brush; a fur brush, a roller brush, or the like, may be employed.

A scanning exposure laser beam is projected from a laser beam scanner (unillustrated), which comprises a laser diode, a polygon mirror, and the like, onto the charged surface of the photosensitive member 1. Since the intensity of the scanning laser beam is modulated with sequential electric digital picture element signals reflecting the image data of a target image, an electrostatic latent image corresponding to the target image is formed on the peripheral surface of the photosensitive member 1.

The electrostatic latent image is developed into a toner image with the use of a reversal development apparatus 3 which employs negatively chargeable, insulative, magnetic, single component toner as developer. A reference numeral 3*a* designates a nonmagnetic development sleeve which is 16 mm in diameter and encloses a magnet. The aforementioned toner is coated on the surface of the development sleeve 3*a*. The development sleeve 3*a* is disposed so that the distance to the surface of the photosensitive member 1 becomes 300 μm, and is rotated at the same velocity as the photosensitive member. To the sleeve 3*a*, development bias voltage is applied from a development bias power source $S_2$. The development bias voltage is superposed voltage composed of a DC voltage of −500 V, and an AC voltage having a frequency of 1,800 Hz and a peak-to-peak voltage of 1,600 V. The development method is a so-called jumping development method.

Meanwhile, a transfer material P as a recording material is delivered with a predetermined timing from an unillustrated sheet feeding section to a pressure nip (transfer section) formed between the photosensitive member 1 and a medium resistance transfer roller 4 as contact type transferring means placed in contact with the photosensitive member 1 with application of a predetermined contact pressure. To the transfer roller 4, a predetermined transfer bias is applied from a transfer bias application power source $S_3$. The transfer roller employed in this embodiment has a resistance value of $5\times10^8$ Ω, and the voltage applied to the transfer roller 4 for transferring the toner image is a DC voltage of +2000 V. While the transfer material P introduced into the transfer section T is passed through the transfer section T, being pinched therein, the toner image formed and borne on the surface of the photosensitive member 1 is transferred onto the photosensitive member facing side of the transfer material P starting from one edge of the image to the other by the electrostatic force and the nip pressure.

After the transfer of the toner image onto the transfer material P, the transfer material P is separated from the surface of the photosensitive member 1, and is introduced into a fixing apparatus 5 based on a thermal fixation system or the like to fix the toner image to the transfer material P. Thereafter, the transfer material P with the fixed image is discharged as a print or a copy. The image forming apparatus described in this embodiment is a cleanerless image forming apparatus which lacks a member for cleaning the surface of the photosensitive member as the image bearing member. In this image forming apparatus, the photosensitive member regions on which the toner remains after the toner image transfer is charged again with a charging device, and is exposed to the laser beam to formed an electrostatic latent image. Thereafter, the development operation is carried out by the developing apparatus at the same time as the residual toner is cleaned by the developing apparatus. More specifically, a development bias (−500 V) which falls between the dark portion potential (−700 V) of the photosensitive member and the light portion potential (−100 V) of the photosensitive member is applied to the sleeve 3*a*, so that an electric field for adhering the toner to the light portion potential from the sleeve 3*a*, and an electric field for returning the toner to the sleeve 3*a* from the dark portion potential, are formed at the same time.

The image forming apparatus in this embodiment employs a cartridge system, in which three processing devices, that is, the photosensitive member 1, the contact type charging member 2, and the development apparatus 3 are housed in a cartridge shell C to render the three devices installable into, or removable from, the main assembly of the image forming apparatus all at once. However, the image forming apparatus compatible with the present invention is not limited to the one described in the forgoing. FIG. 2(*a*) depicts the magnetic brush type charging device employed in this embodiment. FIG. 2(*b*) illustrates a model equivalent to the apparatus illustrated in FIG. 2(*a*). The magnetic brush type charging device in this embodiment comprises an electrically conductive, nonmagnetic, rotary sleeve 2*a* having a diameter of 16 mm, a 230 mm long magnet roller 2*b*, and electrically conductive particles 2*c* held on the surface of the conductive sleeve 2*a* by the magnetic force of the magnetic roller 2*b*. The magnetic roller 2*b* is rendered rotatable within the conductive sleeve 2*a* so that the orientation of the magnetic pole can be optionally set. The distance between the conductive sleeve 2*a* and the surface of the photosensitive member 1 is set to 500 μm, and a layer of the magnetic particles (layer) 2*c* as the contact portion is formed between the conductive sleeve 2*a* and the photosensitive member 1. In this embodiment, five different magnetic particles A–E were tried to compare the resultant images.

Figure 4:
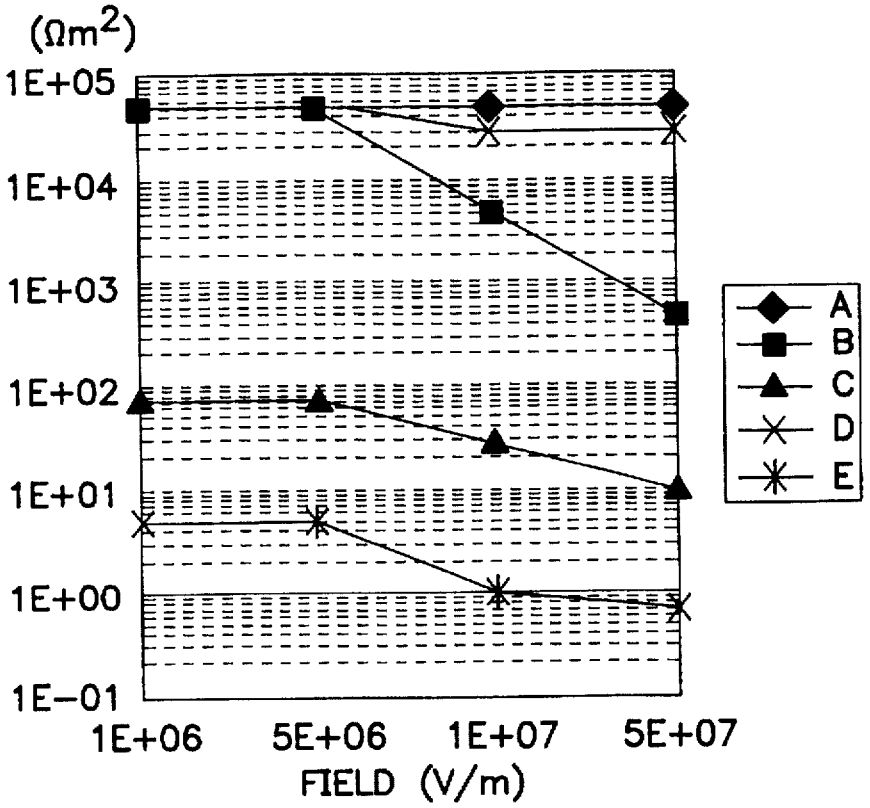
FIG. 4 is a graph showing the relationship between the electric field of a magnetic brush and the resistance value per unit area.

The photosensitive member 1 is charted by placing the magnetic brush in contact with the photosensitive drum 1 while rotating the photosensitive drum 1. While the photosensitive was charged, time constant was measured to obtain the resistance value of the magnetic brush. The dimension of the nip region of the magnetic brush was 200 mm×5 mm. Generally speaking, the resistance value of the magnetic brush is not necessarily the same as that of the magnetic particle. FIG. 4 shows the resistance values for five different magnetic brushes A–E. In the figure, the strength (V/m) of the electric field is plotted on the axis of abscissa, and the unit area resistance value ($\Omega m^2$) of the contact portion of the magnetic brush type charging device is plotted on the axis of ordinates. Further in FIG. 4, xE+y means $x10^y$. As for the method for measuring the resistance value, an electrically conductive aluminum drum is placed in the apparatus in place of the photosensitive drum 1. The conductive drum is grounded. Then, the strength of the electric field formed between the electrode of the charging member and the conductive drum is varied by changing the voltage applied to the charging member. For example, when the area size of the contact portion of the charging device is a ($m^2$), and a measured resistance value is b (Ω), the unit area resistance value is ab ($\Omega m^2$).

These particles were employed to compared the images formed using the magnetic brushes A–E. First, images were formed with the frequency of the AC bias fixed at 500 Hz. FIG. 7 gives the results obtained by evaluating the fogs of the thus formed images. A symbol "G" indicates that the amount of the fog was tolerable, and a symbol "NG" indicates that the amount of fog was not tolerable. Next, images were formed with the amplitude of the AC bias fixed at 1,000 V while varying the frequency of the AC bias. The results obtained by evaluating the fogs of the thus obtained images are given in FIG. 8.

Figure 5:
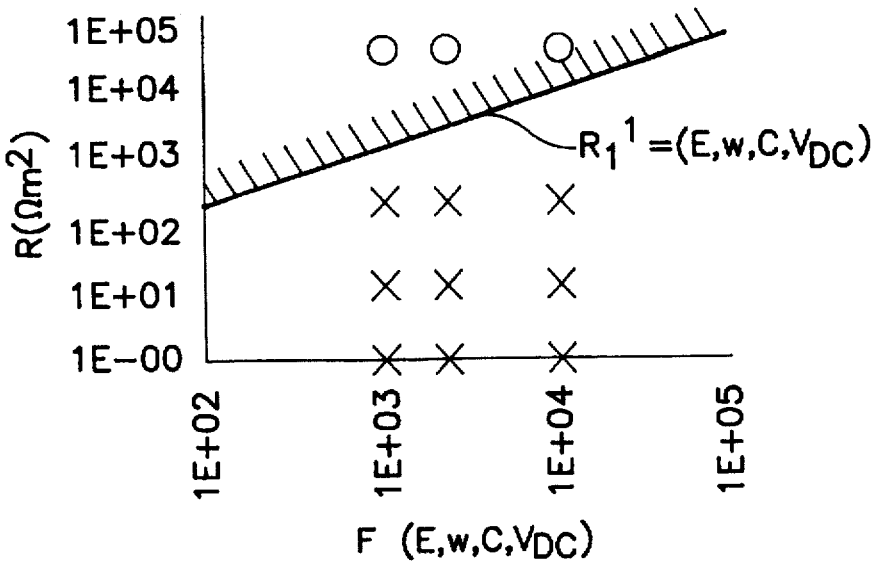
FIG. 5 is a graph showing the relationship between the strength F of the magnetic brush and the resistance value $R_1$ per unit area, in the first embodiment.

When the magnetic brush C and E which had a low $R_1$ were employed, the fog attributable to the charge nonuniformity caused by the AC component of the applied voltage appeared in the images. In the case of the magnetic brush E, pinhole leakage occurred in addition to the fogs. On the contrary, when the magnetic brush A, B and D which had a high $R_1$, were employed, no fog appeared in spite of the application of AC voltage. In FIG. 5, the results of the image evaluation are displayed in conjunction with a graph showing the relationship between $R_1$ and F(E, w, C, $V_{DC}$). The hatched area, in which $R_1$>F(E, w, C, $V_{DC}$), is the region in which no fog appeared. The fog and leak can be prevented when a magnetic brush whose resistance value satisfies the following conditions:

$$F(E,w,C,V_{DC})<R_1 \text{ and } 1<R_2$$

As described above, the fog and leak which occur when an AC voltage is applied could be prevented by employing a magnetic brush whose resistance value satisfied the following conditions:

$$F(E,w,C,V_{DC})=20E/(wCV_{DC})<R_1 \text{ and } 1<R_2$$

However, in consideration of the need for faster speed, the resistance value of the charging member is preferably lower immediately after changing begins. Therefore, in this embodiment, a magnetic brush whose resistance value satisfies the following conditions is employed:

$$F(E,w,C,V_{DC})<R_1 \text{ and } 1<R_2$$

Further, the resistance value of the charging member in this embodiment is smaller when the strength of the electric field is no less than $|E/d_{SD}|$ and no more than $E+V_{DC}/d_{SD}$ù than when the strength of the electric field is no more than ùE/$d_{SD}$ù.

Images were formed using the magnetic brushes whose characteristics were shown in FIG. 4, and were evaluated. As for the image forming apparatus, the same apparatus illustrated in FIG. 1 was employed, except that the surface velocity of the photosensitive drum 1 and the sleeve 2*a* were changed to 1.5 time the velocity used in the first embodiment, and the other process speeds were also changed to 1.5 time the original speeds. As for the bias for charging, a superposed combination of a DC voltage of 700 V and an AC voltage having a frequency of 700 Hz and an amplitude of 600 V) was employed. The image evaluation results are given in FIG. 9. When the magnetic brushes A and D were used, charge failure occurred. When the magnetic brush C was used, charge failure did not occur, but fogs attributable to the AC component appeared. When the magnetic brush E was used, pinhole leakage occurred in addition to charge failure. However, when the magnetic brush B was employed, preferable images could be obtained.

As described above, when the resistance value of a magnetic brush satisfied the following conditions:

$$F(E,w,C,V_{DC})<R_1 \text{ and } 1<R_2$$

and, further, the resistance value of the charging member is smaller when the strength of the electric field is no less than $|E/d_{SD}|$ and no more than $|E+V_{DC}/d_{SD}|$, than when the strength of the electric field is no more than $|E/d_{SD}|$, charging speed could be increased while successfully preventing the occurrence of the fog attributable to the AC voltage application.

Embodiment 2

This embodiment is essentially the same as the first embodiment, except that the photosensitive drum in this embodiment comprises a surface layer whose resistance displays electric field dependency. The image forming apparatus employed in this embodiment is essentially the same as the one employed in the first embodiment, except that the photosensitive drum has a surface layer whose resistance displays electric field dependency, and also, the surface velocity of the photosensitive member 1 and sleeve 2*a*, as well as the other process speeds, are 1.2 time the velocity of those in the first embodiment. The magnetic brush C whose characteristic was shown in FIG. 4 was employed. As for the charging bias, a superposed combination of a DC voltage of 700 V and an AC voltage having a frequency of 700 Hz and an amplitude of 600 V) was employed.

Figure 6:
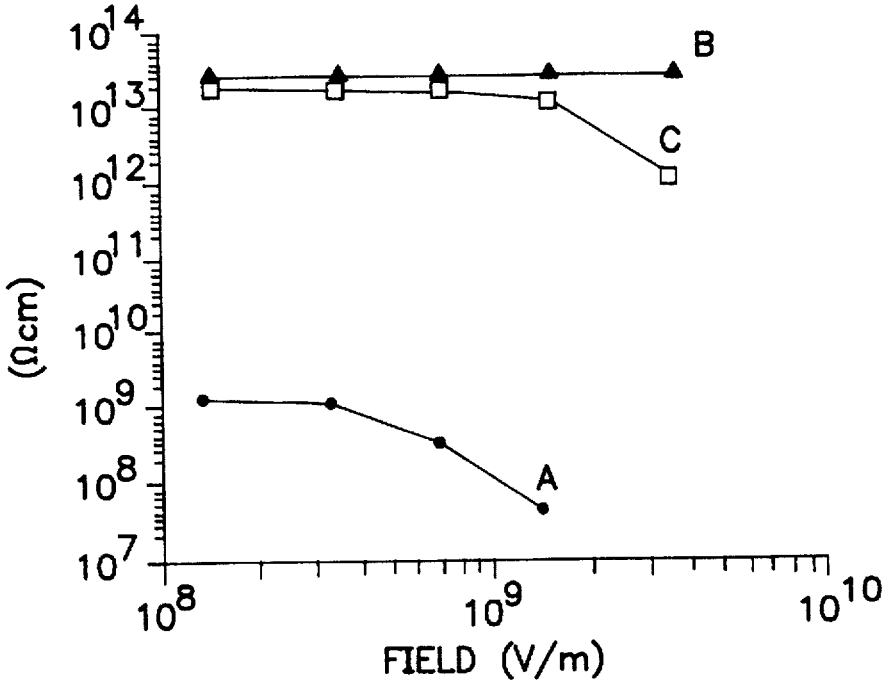
FIG. 6 is a graph showing the relationship between the electric field of the charge drum and the resistance, in the third embodiment of the present invention.
Figure 10:
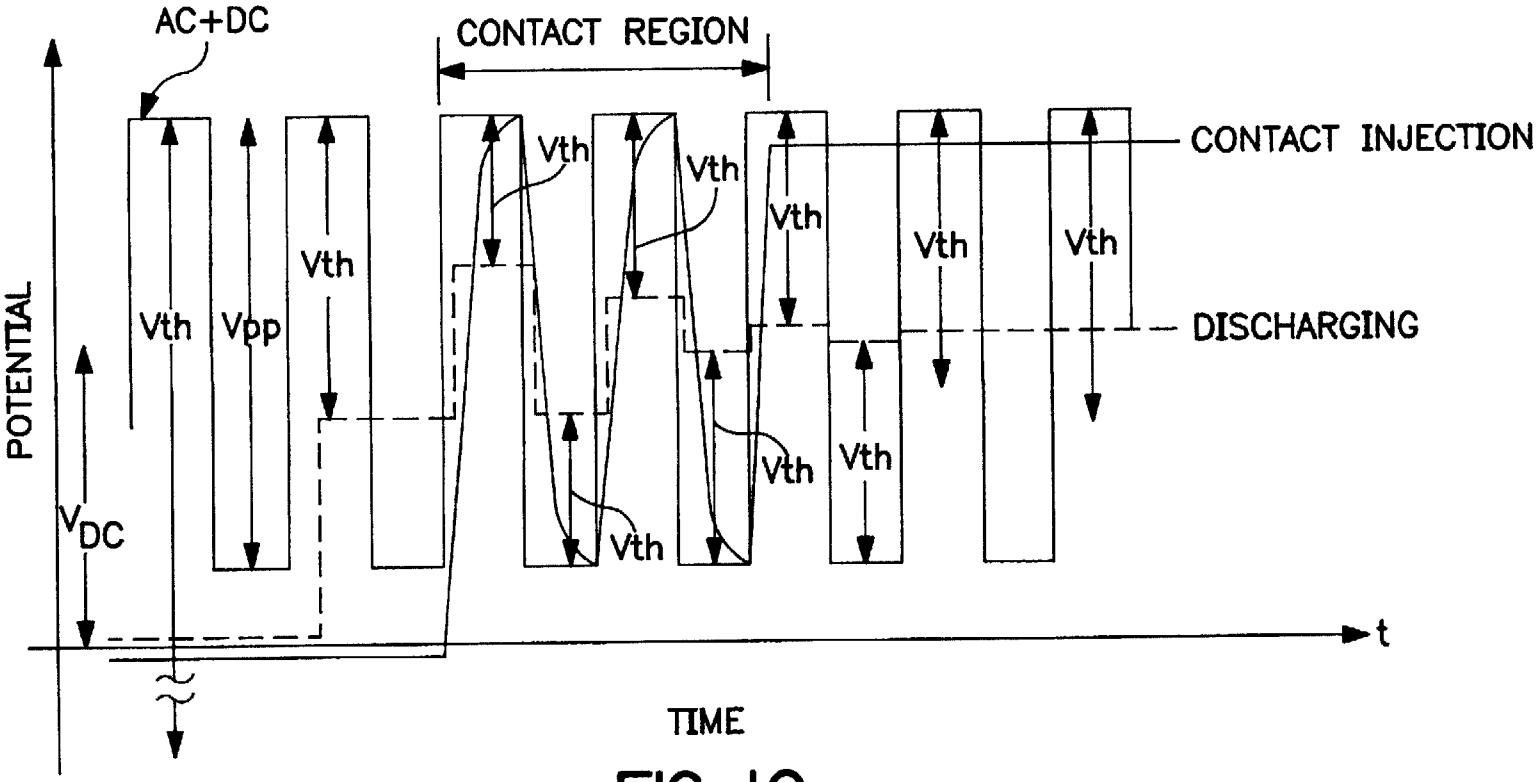
FIG. 10 is a graph depicting a problem that in the case of the contact type charge injection, the surface potential of the image bearing member becomes nonuniform in response to the AC bias.

FIG. 6 shows the relationship between the strengths of the electric fields correspondent to three different surface layers for the photosensitive member, and the resistance value.

When the drum with the surface layer A whose resistance value was no more than $1\times10^9$ (Ωcm), the obtained images suffered from the flowing appearance. Therefore, the resistance value is preferably no less than $1\times10^9$ (Ωcm). Charging speed could be increased when the surface layer C whose resistance value dropped when the strength of the electric field was no less than $|E/d_{SD}|$ (V/m) and no more than $|(E+V_{DC})/d_{SD}|$ (V/m) was used, compared to when the surface layer B whose resistance did not display electric field dependency was used.

In this embodiment, an OPC based photosensitive member was employed, but it may be replaced with a different type photosensitive member. Further, the photosensitive member may be such that comprises a charge carrier layer in the surface layer.

It is preferable that the electrostatic capacity of the photosensitive member is measured by placing an electrically conductive member with negligible resistance in contact with the photosensitive member, and then, applying an AC voltage to the conductive member. In this case, the frequency of the AC voltage is preferably in a range of 10 kHz to 20 kHz.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member;

a charging member contactable to said image bearing member for effecting contact charging of said image bearing member, said charging member being supplied with a voltage having a DC component and an AC component, and said charging member being provided with an electrode for receiving the voltage;

wherein the following is satisfied:

when an electric field formed between said image bearing member and said electrode is not more than $|E/d_{SD}|$(V/m), a resistance of said charging member per unit area of contact between said image bearing member and said charging member is larger than $$20E/(wCV_{DC})(\Omega m^2)$$

and is larger than the resistance when the electric field is more than $|E/d_{SD}|$(V/m), and not more than $|(E+V_{DC})/d_{SD}|$ (V/m)

where E(V) is an amplitude of the AC component; w(rad) is an angular velocity of the AC component; $d_{SD}$ (m) is a minimum distance between said electrode and said image bearing member; C(F/m$^2$) is an electrostatic capacity per unit area of said image bearing member; and $V_{DC}$ (V) is a voltage of the DC component.

2. An apparatus according to claim 1, wherein when the electric field is more than $|E/d_{SD}|$(V/m), and not more than $|(E+V_{DC})/d_{SD}|$(V/m), then the resistance of said charging member per unit contact area is larger than 1 (Ωm$^2$).

3. An apparatus according to claim 1, wherein when the electric field is more than $|E/d_{SD}|$(V/m), and not more than $|(E+V_{DC})/d_{SD}|$(V/m), then the resistance of a surface layer of said image bearing member is smaller than that when it is not more than $|E/d_{SD}|$(V/m).

4. An apparatus according to claim 1, wherein said charging member has an electroconductive particle layer contactable to said image bearing member.

5. An apparatus according to claim 4, wherein said charging member includes a magnet, and said electroconductive particle layer is of magnetic particles.

6. An apparatus according to claim 1, wherein said charging member and said image bearing member moves in opposite directions at a contact portion therebetween.

7. An apparatus according to claim 1–6, wherein said image bearing member has a charge injection layer at its surface, and said charge injection layer has a volume resistivity of $1\times10^9$ to $1\times10^{14}$ (Ωcm).

8. An apparatus according to claim 1, wherein said image bearing member comprises an electrophotographic photosensitive member.

* * * * *

UNITED STATES PATENT AND TRADEMARK OFFICE

CERTIFICATE OF CORRECTION

PATENT NO. : 5,729,802

DATED : March 17, 1998

INVENTORS : Jun Hirabayashi, et al.

It is certified that error appears in the above-identified patent and that said Letters Patent is hereby corrected as shown below:

COLUMN 2

Line 4, "changes" should read --changed--; and
Line 48, "suffers" should read --suffer--.

COLUMN 7

Line 44, "form" should read --form of--.

COLUMN 9

Line 30, "formed" should read --form--.

COLUMN 10

Line 1, "charted" should read --charged--;
Line 4, "was" should read --drum 1 was--; and
Line 25, "compared" should read --compare--.

COLUMN 11

Line 10, "1.5 time" should read --1.5 times--;
Line 12, "1.5 time" should read --1.5 times--;
Line 15, "600 V)" should read --600 V--;
Line 45, "1.2 time" should read --1.2 times--; and
Line 50, "600 V)" should read --600 V--.

UNITED STATES PATENT AND TRADEMARK OFFICE

CERTIFICATE OF CORRECTION

PATENT NO. : 5,729,802

DATED : March 17, 1998

INVENTORS : Jun Hirabayashi, et al.

It is certified that error appears in the above-identified patent and that said Letters Patent is hereby corrected as shown below:

COLUMN 12

Line 57, "moves" should read --move--; and
Line 59, "claim 1-6" should read --claims 1-6--.

Signed and Sealed this

Thirteenth Day of October 1998

*Attest:*

*Attesting Officer*

BRUCE LEHMAN

*Commissioner of Patents and Trademarks*